US010202825B2

(12) United States Patent
Themig et al.

(10) Patent No.: US 10,202,825 B2
(45) **Date of Patent: *Feb. 12, 2019**

(54) METHOD AND APPARATUS FOR WELLBORE CONTROL

(71) Applicant: PACKERS PLUS ENERGY SERVICES INC., Calgary (CA)

(72) Inventors: Daniel Jon Themig, Calgary (CA); Michael Kenyon, Calgary (CA)

( * ) Notice: Subject to any disclaimer, the term of this patent is extended or adjusted under 35 U.S.C. 154(b) by 367 days.

This patent is subject to a terminal disclaimer.

(21) Appl. No.: 15/072,010

(22) Filed: Mar. 16, 2016

(65) Prior Publication Data

US 2016/0208571 A1 Jul. 21, 2016

Related U.S. Application Data

(63) Continuation of application No. 13/638,441, filed as application No. PCT/CA2011/000479 on Apr. 21, 2011, now Pat. No. 9,297,234.

(60) Provisional application No. 61/326,776, filed on Apr. 22, 2010.

(30) Foreign Application Priority Data

May 7, 2010 (WO) ..... PCT/CA2010/000727

(51) Int. Cl.

| | |
|---|---|
| ***E21B 34/14*** | (2006.01) |
| ***E21B 34/08*** | (2006.01) |
| ***E21B 33/124*** | (2006.01) |
| ***E21B 34/12*** | (2006.01) |
| ***E21B 43/26*** | (2006.01) |
| ***E21B 33/12*** | (2006.01) |
| *E21B 34/00* | (2006.01) |

(52) U.S. Cl.

CPC ..... *E21B 34/14* (2013.01); *E21B 33/12* (2013.01); *E21B 33/124* (2013.01); *E21B 34/08* (2013.01); *E21B 34/12* (2013.01); *E21B 43/26* (2013.01); *E21B 2034/007* (2013.01)

(58) Field of Classification Search

CPC ..... E21B 34/14; E21B 34/08

See application file for complete search history.

(56) References Cited

U.S. PATENT DOCUMENTS

| | | | |
|---|---|---|---|
| 2,155,609 | A | 4/1939 | McClendon et al. |
| 2,947,363 | A | 8/1960 | Sackett et al. |
| 3,053,322 | A | 9/1962 | Kline |
| 3,054,415 | A | 9/1962 | Baker et al. |
| 3,112,796 | A | 12/1963 | Myers |
| 4,176,717 | A | 12/1979 | Hix |
| 4,520,870 | A | 6/1985 | Pringle |

(Continued)

FOREIGN PATENT DOCUMENTS

| | | | |
|---|---|---|---|
| CA | 2668129 | A1 | 12/2009 |
| WO | WO 2004/022906 | A1 | 3/2004 |

*Primary Examiner* — David J Bagnell
*Assistant Examiner* — Tara E Schimpf

(57) ABSTRACT

A method and apparatus for wellbore control include a downhole facing ball stop and sealing area that can stop and seal with an actuator ball migrating toward surface with wellbore returns or production. The downhole facing ball stop operates with the returning actuator ball to create a seal against any returns or production migrating toward surface such that well control is provided until the ball is removed from the sealing area or a bypass is opened around the seal.

20 Claims, 9 Drawing Sheets

(56) References Cited

U.S. PATENT DOCUMENTS

| | | | | |
|---|---|---|---|---|
| 4,893,678 | A | 1/1990 | Stokley et al. | |
| 6,253,861 | B1 | 7/2001 | Carmichael et al. | |
| 6,634,428 | B2 | 10/2003 | Krauss et al. | |
| 6,820,697 | B1 | 11/2004 | Churchill | |
| 6,907,936 | B2 | 6/2005 | Fehr et al. | |
| 7,021,389 | B2 | 4/2006 | Bishop et al. | |
| 7,108,067 | B2 | 9/2006 | Themig et al. | |
| 7,861,774 | B2 | 1/2011 | Fehr et al. | |
| 2004/0163820 | A1* | 8/2004 | Bishop | E21B 34/06 166/373 |
| 2006/0243455 | A1 | 11/2006 | Telfer et al. | |
| 2007/0272413 | A1 | 11/2007 | Rytlewski et al. | |
| 2008/0000697 | A1 | 1/2008 | Rytlewski | |
| 2009/0071644 | A1 | 3/2009 | Themig | |
| 2011/0100643 | A1 | 5/2011 | Themig et al. | |
| 2011/0108284 | A1 | 5/2011 | Flores et al. | |
| 2011/0127047 | A1 | 6/2011 | Themig et al. | |

* cited by examiner

METHOD AND APPARATUS FOR WELLBORE CONTROL

PRIORITY APPLICATION

This application is a continuation of U.S. application Ser. No. 13/638,441 filed Sep. 28, 2012 and presently pending. U.S. Ser. No. 13/638,441 is a 371 of PCT/CA2011/000479 filed Apr. 21, 2011 which claims the benefit of U.S. provisional application Ser. No. 61/326,776, filed Apr. 22, 2010. PCT/CA2011/000479 claims priority to PCT/CA2010/000727 filed May 7, 2010.

FIELD OF THE INVENTION

The invention relates to a method for well control and, in particular, to a method for controlling wellbore production during wellbore operations.

BACKGROUND OF THE INVENTION

During wellbore operations, it may be useful to control fluid flow toward surface. For example, some operations, such as some wellbore stimulation operations, may generate considerable back flow of fluids. If it desired to perform other wellbore operations in the well without hindrance by such back flow or if it is desired to allow the stimulation fluids to soak in the wellbore, it may be desired to provide well control.

SUMMARY OF THE INVENTION

In one embodiment, there is provided a well control apparatus, for controlling back flow out of a tubing string in a well, the well control apparatus comprising: a constriction formable in the string having an inactive position and an active position, in the active position the constriction forms an underside that defines a seat; a driver that moves the constriction from the inactive position to the active position; and a plug sized to pass through the constriction when the constriction is in the inactive position and moveable and sized to flow back and seal up against the seat of the constriction.

In accordance with another broad aspect of the invention, there is provided a wellbore installation permitting operation to controlling back flow out of a tubing string in a well, the well control apparatus comprising: a tubing string positioned in a wellbore, the tubing string including an upper end, a lower end opposite the upper end, an inner bore and an outer surface and the tubing string forming an annulus between the tubing string outer surface and the wellbore; a first annular seal disposed about the tubing string and creating a seal against fluid migration therepast in the annulus, a second annular seal axially offset from the first annular seal and disposed about the tubing string, creating a seal against fluid migration therepast in the annulus, the first annular seal and the second annular seal having an open section of annulus therebetween; a constriction formable in the inner bore of the string positioned axially between the first annular seal and the second annular seal, the constriction having an inactive position and an active position, in the active position the constriction forming an underside that defines a seat; a driver that moves the constriction from the inactive position to the active position; and a plug sized to pass through the constriction when the constriction is in the inactive position and moveable and sized to flow back and seal up against the seat of the constriction to create a seal in the tubing string against flow toward the upper end past the constriction; a first fluid flow port positioned axially between the constriction and the first annular seal, the first fluid flow port openable to provide fluid communication between the inner bore and the annulus; and a second fluid flow port positioned axially between the constriction and the second annular seal, the second fluid flow port openable to provide fluid communication between the inner bore and the annulus.

In accordance with another broad aspect of the invention, there is provided a method for wellbore control, the method comprising: providing a wellbore tubing string apparatus; running the tubing string to a desired position in the wellbore; conveying a plug into the tubing string, the plug selected to form a seal in the tubing string when stopped in the tubing string at an appropriately sized annular sealing area; generating a downhole facing ball stop in the tubing string, the ball stop positioned as a part of or closely uphole of the appropriately sized annular sealing area and positioned uphole of the position of the plug; allowing the plug to flow back uphole in the well until is it stopped by the ball stop and creates a seal in the tubing string against further back flow in the well to provide well control.

In one embodiment, there is provided a method for fluid treatment of a borehole including a main wellbore, a first wellbore leg extending from the main wellbore and a second wellbore leg extending from the main wellbore, the method including: running a tubing string into the first wellbore leg; conveying a plug into the tubing string, the plug selected to form a seal in the tubing string when stopped in the tubing string at an appropriately sized annular sealing area in the tubing string; generating a downhole facing ball stop in the well, the ball stop positioned as a part of or closely uphole of the appropriately sized annular sealing area and positioned uphole of the position of the plug; allowing the plug to flow back uphole in the tubing string until is it stopped by the ball stop and creates a seal in the tubing string against further back flow in the well to provide well control; and performing operations in the second wellbore leg.

In another embodiment, there is also provided a wellbore installation for the a well including a main wellbore, a first wellbore leg extending from the main wellbore and a second wellbore leg extending from the main wellbore, the wellbore installation comprising: a tubing string in the first wellbore leg, the tubing string including an upper end, a lower end opposite the upper end, an inner bore and an outer surface and the tubing string forming an annulus between the tubing string outer surface and the wellbore; a first packer disposed about the tubing string and creating a seal against fluid migration therepast in the annulus, a second packer axially offset from the first packer and disposed about the tubing string, creating a seal against fluid migration therepast in the annulus, the first packer and the second packer having an open section of annulus therebetween; a constriction formable in the inner bore of the string positioned axially between the first packer and the second packer, the constriction having an inactive position and an active position, in the active position the constriction forming an underside that defines a seat; a driver that moves the constriction from the inactive position to the active position; and a ball sized to pass through the constriction when the constriction is in the inactive position and moveable and sized to flow back and seal up against the seat of the constriction to create a seal in the tubing string against flow toward the upper end past the constriction; a first fluid flow port positioned axially between the constriction and the first packer, the first fluid flow port openable to provide fluid communication between the inner bore and the annulus; and a second fluid flow port positioned axially between the constriction and the second packer, the second fluid flow port openable to provide fluid communication between the inner bore and the annulus; and an apparatus in the second wellbore leg, the apparatus including: a plug-actuated tool.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF VARIOUS EMBODIMENTS

Figures 1A, 1B, 1C:
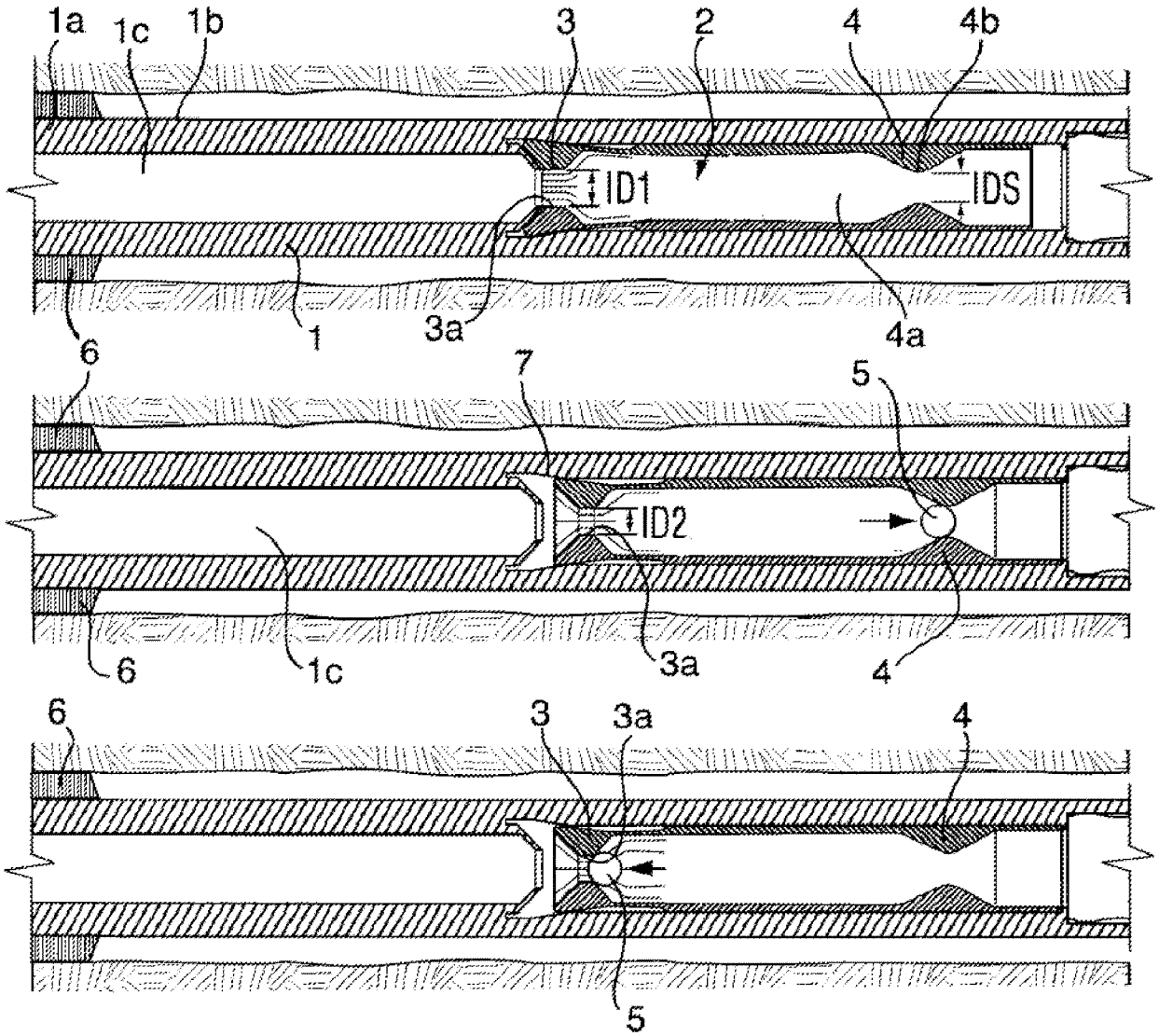
FIGS. 1A to 1C are sequential sectional views through a string according to an aspect of the present invention installed in a well.

The description that follows and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

A wellbore string installation and method have been invented that permit well control during certain operations. In particular, the wellbore string can be operated to provide control against backflow of fluids from the string, but can be opened after control is no longer needed.

The apparatus and methods of the present invention can be used in various borehole conditions including an open hole, a lined hole, a vertical hole, a non-vertical hole, a main wellbore, a wellbore leg, a straight hole, a deviated hole or various combinations thereof.

With reference to FIG. 1, a portion of a wellbore string 1 is shown installed in a wellbore and having a flow control assembly 2 therein. The wellbore string may have an upper end 1*a*, a lower end (not shown) opposite the upper end, an outer surface 1*b* open to the wellbore and an inner bore 1*c*. A packer 6 is installed about the tubing string adjacent upper end 1*a* to create an annular seal in the annulus between the tubing string and the wellbore wall. Packer 6 provides that fluid flow into and out of the wellbore may only be achieved through inner bore 1*c*, with the packer deterring any fluid migration through the annulus.

After the string is positioned in the wellbore, as shown, the flow control assembly may be activated to permit well control, to seal against fluids flowing back in the well up through inner bore 1*c*.

The flow control assembly may take various forms. One possible embodiment of a flow control assembly is shown in FIG. 1, including a constriction member 3 in the string which is moveable from an inactive, retracted position (FIG. 1A) having a first drift diameter to an active, constricted position (FIGS. 1B and 1C) having a second drift diameter smaller than the first drift diameter. The flow control assembly further includes a driver 4 that moves the constriction member from the inactive position to the active position and a plug 5 that can be launched and pass through the constriction member when the constriction member is in the inactive position, but can flow back when moved by fluid flow and seals up against the sealing surface of the constriction member, when the constriction member is in its active, constricted position (FIG. 1C).

The constriction member 3 acts as a ball stop and has an underside 3*a* (on its downhole side, closer to the lower end of the string) that defines a sealing surface at least when the constriction member is in the constricted position. It is appropriately sized to stop and create a seal with the plug 5. In particular, the constriction due to its reduced drift diameter, when constricted acts to stop an appropriately sized plug that flows against it and has a sealing surface on or adjacent its underside that creates a seal with the stopped plug. The sealing surface is formed to operate to create a substantial or perfect seal with a downhole plug, such as a ball. As will be appreciated, such sealing surfaces may take various forms, but generally present a surface that presents a complete annular and substantially tangential surface against which a rounded surface of a downhole plug can come into contact. Such surfaces may be substantially frustoconical or cylindrical, depending on the surface of the plug against which the sealing area is intended to seal.

Plug 5 may take various forms such as a ball (as shown), a dart or other plugging device. The plug operates at least to create a seal against the underside of the constriction member. As will be appreciated, a spherical ball is particularly useful, as it is orientation independent.

In operation, the flow control assembly initially has constriction member 3 in the inactive position (FIG. 1A) and ball 5 may be introduced to tubing string 1 and moved past the constriction member such that it is positioned in the tubing string below (i.e. downhole of) constriction member 3 (FIG. 1B). Driver 4 may then be activated to move the constriction member to the active, constricted position, such that underside 3*a* forms the ball stop and sealing area. When the ball is flowed back with the flow of wellbore fluids, the ball becomes sealed against underside 3*a* and creates a seal against fluids moving upwardly through the tubing string inner bore 1*c* (FIG. 1C). The packer 6 deters any fluid flow past it along the outside of the tubing string. As such, all upward flow from the wellbore in which the tubing string is positioned is sealed off because of operation of the packer outside the string and the seal created at the constriction inside the tubing string.

The constriction may take various forms while still permitting operation to move from a retracted position having one diameter to a constricted, active position having a smaller diameter and to have an underside that is capable of forming a ball stop and a seal with a ball. In the illustrated embodiment of FIG. 1, constriction member 3 is a collet. The collet is installed in a surrounding housing 7 having an inner diameter that tapers from a first end to a narrower, second end. The collet has radially outwardly biased fingers and is moveable along the length of the housing. When the collet is positioned with its fingers in the first end, the collet is retracted and has an opening between the fingers with an inner diameter ID1 greater than the diameter of ball 5. However, the collet can be moved axially into the narrower, second end where the collet fingers will be constricted and the opening between them reduced such that the inner diameter ID2 is less than the ball.

In this embodiment, the underside of each collet finger is formed to taper gradually from its lower end to its upper end and the sides of adjacent fingers are formed to contact closely at this tapering, such that when the fingers are constricted radially inwardly, they together define a substantially solid, frustoconical surface, against which a ball can become stopped and seal. While in this embodiment, the underside of the fingers is the structure that both causes the ball to stop and provides the sealing effect against back flow, it is to be understood that the ball stop and sealing structures can be separate. For example, the ball stop can be a structure that itself has no sealing function but operates to hold the ball in an annular sealing area adjacent the ball stop.

It will be appreciated then that driver 4 can take various forms to perform its function of moving the constriction member from the inactive to the active positions. In this illustrated embodiment, driver 4 operates to activate the constriction member by moving the collet along the taper of its housing 7 from the first end to the narrower, second end. In particular, in this embodiment, driver 4 is a ball stop/seat connected to the collet that is operable to stop, and create a seal with, a ball such that fluid pressure can be built up to drive the ball stop/seat. For example, the driver can be formed as a sleeve 4*a* with the collet fingers secured to its upper end and a ball/stop 4*b* seat formed on an inner diameter of the sleeve. In this illustrated embodiment, the driver is formed to catch and seal with the same ball 5 that creates a seal against the underside 3*a* of the constriction member. Of course, two separate balls could be used, if desired.

The flow control apparatus can be employed in various string configurations and installations. One such configuration is described below.

Figure 2A:
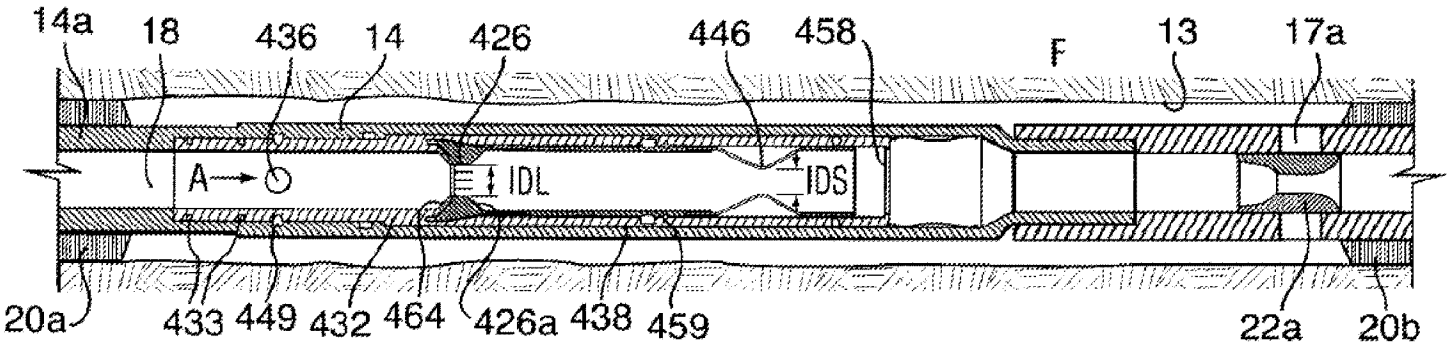
FIGS. 2A to 2E are sequential sectional views through a string according to an aspect of the present invention installed in a well.
Figure 2B:
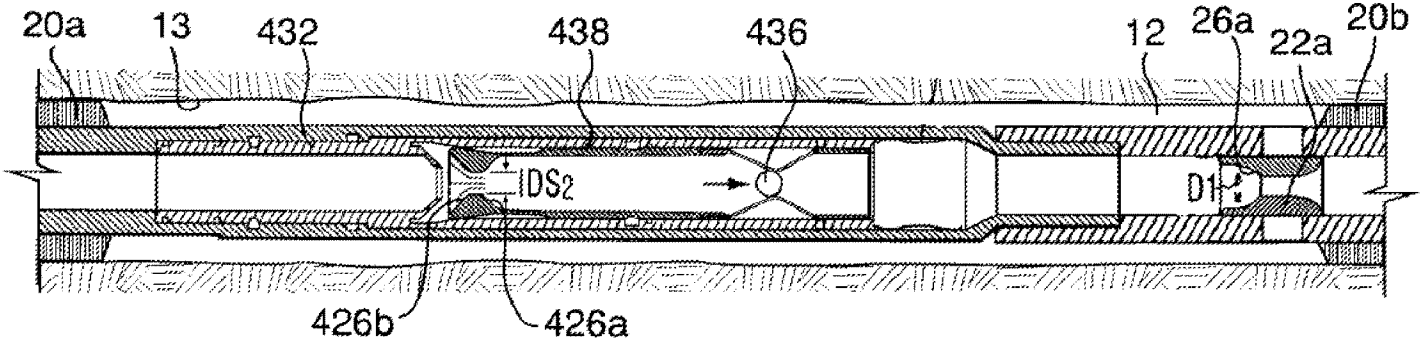

Referring to FIGS. 2A and 2B, a portion of wellbore fluid treatment apparatus is shown positioned in a wellbore and which includes components for well control. While other string configurations are available with plug-actuated tools, the present apparatus includes at least one plug-actuated sliding sleeve. In the assembly illustrated, the wellbore fluid treatment apparatus is used to control fluid flow through the string and the apparatus can be used to effect fluid treatment of a formation F through wellbore defined by a wellbore wall 13, which may be open hole (also called uncased) as shown, or cased. The wellbore fluid treatment apparatus includes a tubing string 14 having an upper end 14*a* which is accessible from surface (not shown). Upper end 14*a* in this embodiment is open, but may have connected thereto further tubing extending toward surface. Upper end 14*a* provides access to an inner bore 18 of the tubing string. Tubing string 14 may be formed in various ways such as by an interconnected series of tubulars, by a continuous tubing length, etc., as will be appreciated. Tubing string 14 includes at least one interval including one or more ports 17*a* opened through the tubing string wall to permit access between the tubing string inner bore 18 and wellbore wall 13. Any number of ports can be provided in each interval. The ports can be grouped in one area of an interval or can be spaced apart along the length of the interval.

A sliding sleeve 22*a* is disposed in the tubing string to control the open/closed state of ports 17*a* in each interval. In this embodiment, sliding sleeve 22*a* is mounted over ports 17*a* to close them against fluid flow therethrough, but sleeve 22*a* can be moved away from a port closed position covering the ports to a port open position, in which position fluid can flow through the ports 17*a*. In particular, the sliding sleeve is disposed to control the opening of the ports of the ported interval through the tubing string and are each moveable from a closed port position, wherein the sleeve covers its associated ported interval (FIG. 2A), to a position not completely covering the ports wherein fluid flow of, for example, stimulation fluid is permitted through ports 17*a* (as shown by FIG. 2B). In other embodiments, the ports can be closed by other means such as caps or second sleeves and can be opened by the action of a sliding sleeve or other actuating device moving through the string to break open or remove the caps or move the second sleeves.

Often the assembly is run in and positioned downhole with the sliding sleeve in its closed port position and the sleeve is moved to its open port position when the tubing string is ready for use in fluid treatment of the wellbore.

Figure 2C:
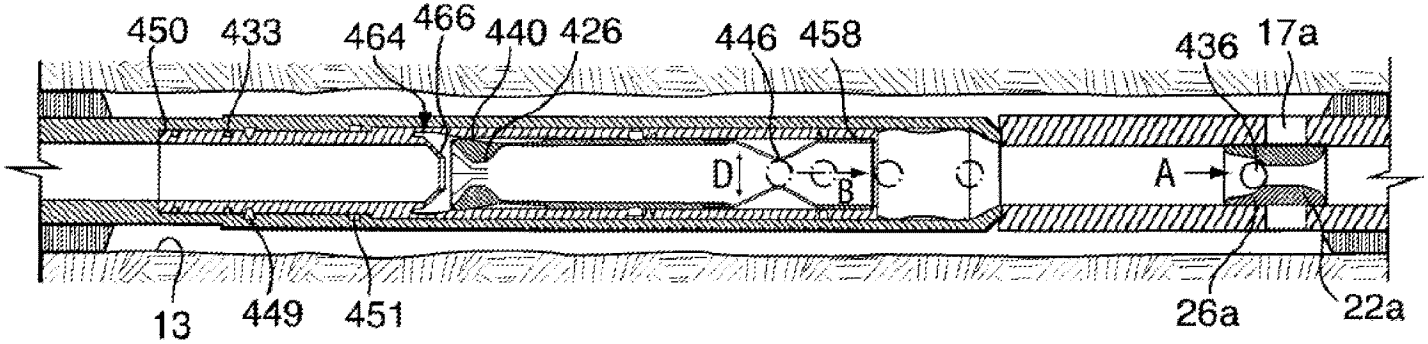

Sliding sleeve 22*a* may be moveable remotely between its closed port position and its open port position (a position permitting through-port fluid flow), without having to run in a line or string for manipulation thereof. In one embodiment, the sliding sleeve may be actuated by a plug, such as a ball 436 (as shown), a dart or other plugging device, which can be conveyed in a state free from connection to surface equipment, as by gravity and/or fluid flow, into the tubing string. The plug is selected to land and seal against the sleeve to move the sleeve. For example, in this case ball 436 engages against sleeve 22*a*, and, when pressure is applied through the tubing string inner bore 18 through upper end 14*a*, ball 436 seats against and creates a pressure differential across the sleeve and the ball seated therein (above and below) the sleeve which drives the sleeve toward the lower pressure (bottomhole) side (FIG. 2C).

In the illustrated embodiment, the inner surface of sleeve 22*a* which is open to the inner bore of the tubing string has defined thereon a seat 26*a* onto which an associated plug such as ball 436, when launched from surface, can land and seal thereagainst. When the ball seals against sleeve seat 26*a* and pressure is applied or increased from surface, a pressure differential is set up which causes the sliding sleeve on which the ball has landed to slide to a port-open position. When ports 17*a* of the ported interval are opened, fluid can flow therethrough to the annulus 12 between the tubing string and the wellbore wall 13 and thereafter into the formation F.

While only one sleeve is shown in FIG. 2, the string may include further ports and/or sleeves below sleeve 22*a*, on an extension of the length of tubing string extending opposite upper end 14*a*. Where there is a plurality of sleeves, they may be openable individually or in groups to permit fluid flow to one or more wellbore segments at a time, for example, in a staged treatment process. In such an embodiment, for example, each of the plurality of sliding sleeves may have a different diameter seat and, therefore, may each accept a different sized plug. In particular, where there is a plurality of sleeves and it is desired to actuate them each individually or in groups, the lower-most sliding sleeve has the smallest diameter seat and accepts the smallest sized ball and sleeves that are progressively closer to surface may have larger seats and require larger balls to seat and seal therein. For example, as shown in FIG. 2B, sleeve 22*a* is closest to surface and includes an actuation seat 26*a* having a diameter D1 which is sized to stop ball 436 and be actuated thereby. Therebelow, a second sleeve may be installed in the string that controls the open/closed condition of another set of ports and includes a seat having a diameter D1 or D2 (which is less than D0 and which is also actuable by a ball that can pass through seat 26*a* but will land in and actuate the second sleeve. There may be other sleeves downhole of the second sleeve that include diameters of D1 or smaller. This provides that the sleeve closest to the lower end, toe of the tubing string can be actuated first to open its ports, this by first launching a smallest ball, which can pass though all of the seats of the sleeves closer to surface but which will land in and seal against the lowest sleeve.

One or more packers, such as packers 20*a*, 20*b*, may be mounted about the string and, when set, seal an annulus 31 between the tubing string and the wellbore wall, when the assembly is disposed in the wellbore. The packers may be positioned to seal fluid passage through the annulus and/or may be positioned to create isolated zones along the annulus such that fluids emitted through each ported interval may be contained and focused in one zone of the well. In this embodiment, packer 20*a* may be positioned between ports 17*a* and upper end 14*a* to prevent fluid introduced through ports 17*a* from flowing through annulus 12 into the remainder of the well through the annulus around upper end 14*a*. Packer 20*b* is positioned downhole of ports 17*a*, which is about the tubing string on a side of the ports opposite upper end 14*a*.

The packers may take various forms. Those shown are of the solid body-type with at least one extrudable packing element, for example, formed of rubber. Solid body packers including multiple, spaced apart expandable packing elements on a single packer mandrel are particularly useful especially, for example, in open hole (unlined wellbore) operations. In another embodiment, a plurality of packers is positioned in side-by-side relation on the tubing string, rather than using one packer between each ported interval. The packers can be set by various means, such as plug actuation, hydraulics (including piston drive or swelling), mechanical, direct actuation, etc.

The lower end of the tubing string can be open, closed or fitted in various ways, depending on the operational characteristics of the tubing string that are desired. For example, in one embodiment, the end includes a pump-out plug assembly. A pump-out plug assembly acts to close off the lower end during run in of the tubing string, to maintain the inner bore of the tubing string relatively clear. However, by application of fluid pressure, for example at a pressure of about 3000 psi, the plug can be blown out to permit fluid flow through the string and, thereby, the generation of a pressure differential. As will be appreciated, an opening adjacent lower end is only needed where pressure, as opposed to gravity, is needed to convey the first ball to land in the lower-most sleeve. Alternately, the lower-most sleeve can be hydraulically actuated, including a fluid actuated piston secured by shear pins, so that the sleeve can be opened remotely without the need to land a ball or plug therein.

In other embodiments, not shown, the end can be left open or can be closed for example by installation of a welded or threaded plug.

Centralizers and/or other standard tubing string attachments can be used, as desired.

In use, the wellbore fluid treatment apparatus, as described with respect to FIG. 2, can be used in the fluid treatment of a wellbore. For selectively treating formation F through annulus 12, the above-described string is run into the borehole and the packers are set to seal the annulus at each packer location. Fluids can then be pumped down the tubing string and into a selected zone of the annulus, such as by increasing the pressure to pump out the plug assembly. Alternately, a plurality of open ports or an open end can be provided or lower most sleeve can be hydraulically openable.

When it is desired to treat a selected zone, a sealing plug is launched from surface and conveyed by gravity or fluid pressure to actuate its target sliding sleeve. In some embodiments, the sealing plug seals off the tubing string below its target sleeve and opens the ported interval of its target sleeve to allow fluid communication between inner bore 18 and annulus 12 and permit fluid treatment of the formation therethrough. The sealing plug is sized to pass though all other seats between upper end 14*a* and its target seat, but will be stopped by its target seat to provide actuation thereof. After the sealing plug lands, a pressure differential can be established across the ball/sleeve which will eventually drive the sleeve to the low pressure side and, thereby open the ports covered by the sleeve.

Figure 2D:
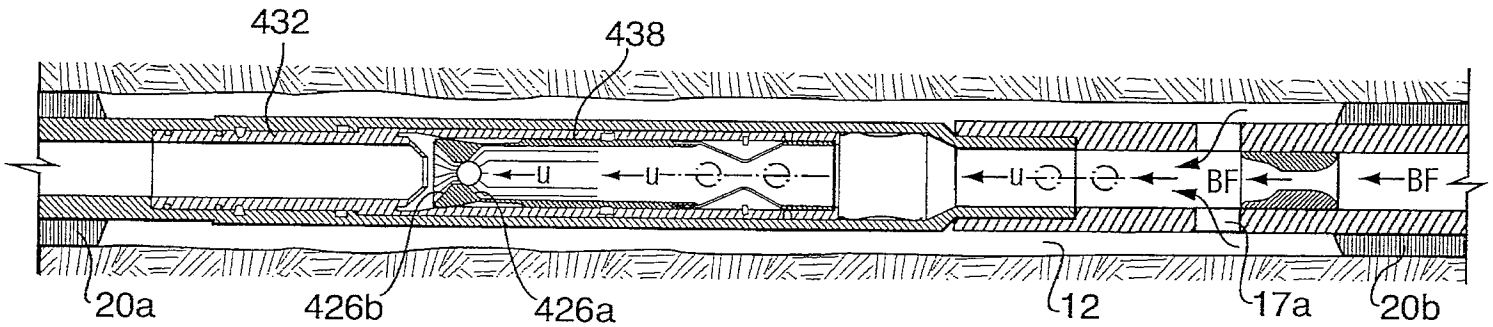

When it is desired to open ports 17*a*, ball 436 is launched. Ball 436 is sized to be caught in seat 26*a*. Ball 436 is conveyed by fluid or gravity to move through the tubing string, arrows A (as shown in FIGS. 2A and 2B), to eventually seat in and seal against sleeve 22*a* (FIG. 2C). This moves sleeve to open ports (FIG. 2D).

As will be appreciated by teachings hereinbelow, ports 17*a* may be opened for various reasons. In one embodiment, ports 17*a* are opened to permit fluid treatment of the annulus between packers 20*a*, 20*b*.

The balls can be launched without stopping the flow of treating fluids.

The apparatus is particularly useful for stimulation of a formation, using stimulation fluids, such as for example, acid, gelled acid, gelled water, gelled oil, $CO_2$, nitrogen and/or proppant laden fluids. The apparatus may also be useful to open the tubing string to production fluids.

It is to be understood that the numbers of ported intervals in these assemblies can range significantly. In a fluid treatment assembly useful for staged fluid treatment, for example, at least two openable ports from the tubing string inner bore to the wellbore are generally provided such as at least two ported intervals or an openable end and one ported interval.

After treatment, once fluid pressure is reduced from surface, the pressure holding the balls in their sleeve seats will be dissipated. As shown in FIG. 2D, ball 436 may be unseated by pressure from below and may begin to move upwardly, arrows u, through the tubing string along with a back flow of fluids, arrows BF. In a prior art system, the fluids may flow upwardly past the upper end 14*a*, which may interfere with other wellbore operations.

However, in the illustrated embodiment, a flow control assembly is provided to create a fluidic seal in the string, preventing fluids from passing upwardly past the assembly toward the upper end. The assembly also may provide a plug retainer function, being formed and positioned to retain the plugs, such as ball 436, in the tubing string. The assembly also permits the re-opening of the tubing string to upward flow therethrough when such back flow is no longer problematic.

The flow control assembly of FIG. 2 includes a constriction member in the form of a collet 426 in the string having an underside 426*a* that forms a seat when constricted to its active position, a driver in the form of a seat 446 that moves the collet 426 from an inactive position to an active position and a ball 436 that can be moved downwardly through collet 426 but is free to flow back and seal up against underside 426*a*, when the collet 426 is constricted. The sizes of the ball, the inner diameter of the collet in the inactive and active positions and the size of driver seat both before and after use to drive, are correspondingly selected to permit this initial passage of ball through collet and use of the ball to drive constriction of and later seal against the collet. In this embodiment, the ball used to actuate the driver also drives a fracing port sleeve and creates the seal for well control.

Figure 2E:
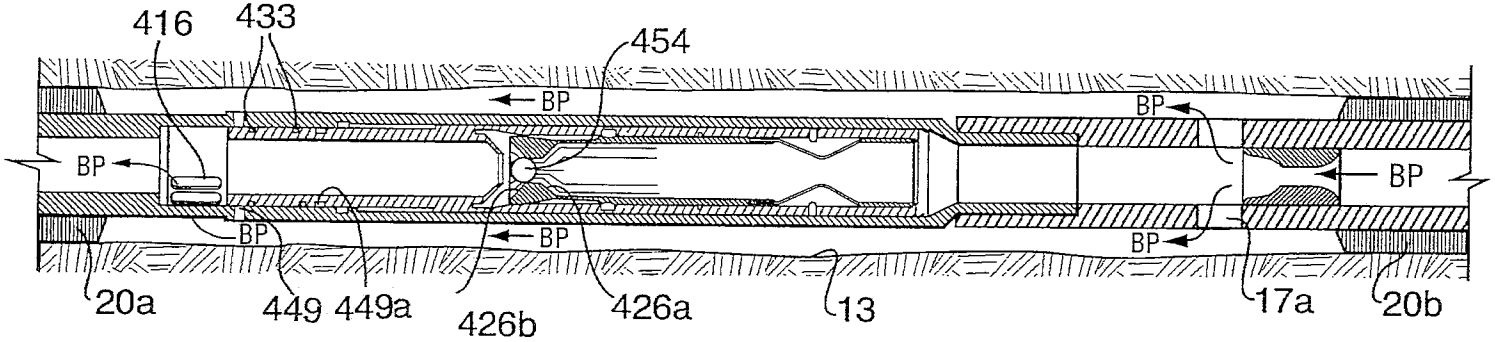

The flow control assembly also, in this embodiment, includes a mechanism for reopening the tubing string to back flow when desired. In particular, a plurality of ports 416 are provided through the tubing string uphole of collet 426, between the collet and packer 20*a*, such that when another set of ports downhole of collet are open to the annular area in communication with ports 416, fluid can bypass the seal formed at collet 426 (FIG. 2E). In this embodiment, for example, ports 17*a* are openable to the annular area in communication with ports 416.

The illustrated tubing string installation utilizes a driver that allows a staged constriction of collet 426 to create a downhole facing seat against which a seal can be formed to resist back flow of fluids out of the tubing string. In this embodiment, the constriction of collet 426 also causes formation of an uphole facing seat 426*b* that can be used to drive movement of a sleeve 432 to open ports 416.

The tubing string is run in initially with the flow control assembly in the un-shifted position (FIG. 2A) with collet 426 initially in a retracted, inactive position with a diameter IDL selected to be larger than the outer diameter of the ball to be used to control back flow and all other balls to be used in the tubing string below the collet such as to shift sleeve 22*a*. As noted above, in this embodiment, ball 436 serves both functions. Initially, also, the port openings 416 in the outer housing 450 of the tubing string segment are isolated from the inner bore of the tubing string segment by a solid wall section of a sleeve 432. O-rings 433 are positioned to seal the interface between sleeve 432 and housing 450 on each side of the openings. The inner sleeve is held within the outer housing by shear pins 449 that thread through the external housing and engage a slot 449*a* machined into the outer surface of sleeve 432. The range of travel of the inner sleeve along housing 450 is restricted by torque pins 451.

Ball seat 446, which acts as the driver for collet 426, is formed on a second sleeve 438 held within and initially pinned to the inner sleeve by shearable pins 459. The second sleeve also carries collet 426 such that any movement of second sleeve 438, caused by a pressure differential across seat 446, results in movement of the collet. Ball seat 446 has a diameter IDS, which is smaller than IDL and sized to stop and create a seal with ball 436. In this illustrated embodiment, ball seat 446 is yieldable.

Because the diameter of ball seat 446 is smaller than the diameter of collet in the inactive position, sized to stop the ball, ball 436 can be introduced to pass through the collet, but land in and be stopped by ball seat 446. When landed (FIG. 2B), the ball isolates the upstream tubing pressure from the downstream tubing pressure across seat 446 and if the upstream pressure increases by surface pumping, the pressure differential across the seat develops a force that exceeds the resistive shear force of the pins 459 holding the second sleeve within inner sleeve 432. As the second sleeve moves, collet 426 then travels a short distance within the inner sleeve and moves into an area of reduced diameter 440 causing the collet fingers to be constricted and resulting in a decrease in its diameter to IDS1, which is less than IDL, across the open area centrally between collet fingers. Because seat 446 is yieldable, with a further increase in pressure, the differential force developed is sufficient to push ball 436, arrows B, FIG. 2C, through the yieldable ball seat. When pushed through, the ball can simply reside downhole of seat 446 or, for efficiency, that ball may be the one that travels (arrows A and B, FIG. 2C) down to seat in and actuate a ball actuated device, such as in this embodiment, sliding sleeve-valve 22*a*.

The yieldable seat can be formed in any of various ways. For example, in this embodiment, yieldable seat 446 is formed as a necked area in the material of the secondary sleeve and is formed to be yieldable by plastic deformation at a particular pressure rating. In one embodiment, the yieldable seat is a necked area in the sleeve material with a hollow backside such that the material of the sleeve protrudes inwardly at the point of the necked area and is v-shaped in section, but the material thinning caused by hollowing out the back side causes the seat to be relatively more yieldable than the sleeve material would otherwise be.

Movement of the secondary sleeve is stopped by a return 458 on the inner sleeve forming a stop wall. The stop wall causes any further downward force on sleeve 438 to be transmitted to inner sleeve 432.

As noted above, after ball 436 passes seat 446 and pressure is reduced uphole of the well control assembly, fluids in the string and from the annulus and formation may begin to flow back, arrows BF, toward surface and through upper end 14*a*. This fluid flow carries ball 436 uphole until it reaches the well control assembly. Ball 436 can move through seat 446, as it is yieldable or has already plastically yielded to allow ball 436 to pass downwardly. However, ball 436 but is sized to be stopped by and seal against underside 426*a* of the collet. When ball 436 lands on and seals against underside 426*a*, flow through the collet at diameter IDS2 is substantially stopped (FIG. 2D). As fluids continue to flow back, pressure is generated that maintains the ball in the sealing position. Fluid cannot bypass the seal at the collet since packer 20*a* seals the annulus and the tubing string is sealed uphole of the collet (ports 416 are closed by sleeve 432).

A lock can be provided to prevent collet 426 from sliding back to the retracted position. For example, a lock such as a c-ring, catches, etc., may act between the second sleeve and the inner sleeve to prevent the second sleeve from sliding back away from the area of reduced diameter 440.

When it is desired to open the string to back flow of fluids, to permit fluids to pass upwardly through upper end 14*a*, ports 416 are opened to allow a bypass out through ports 17*a*, along the annulus and in though ports 416. To open ports 416, recall that collet 426 was constricted and such constriction forms a ball seat 426*b* on the uphole side thereof. A ball 454 may, therefore, be pumped down to the now formed seat 426*b* (FIG. 2E). Ball 454 is selected to be larger than IDS1 such that it is stopped by collet 426 and seals off the upstream pressure from the downstream pressure. Ball 454 may be the same size as ball 436. Increasing the upstream pressure creates a pressure differential across ball 454 and collet 426 that acts on the inner sleeve and results in a force that is resisted by the shear pins 449 holding the inner sleeve in place. When this force on the inner sleeve exceeds the resistive force of the shear pins 449, the pins shear off and the inner sleeve slides down, as permitted by torque pins 451. Port openings 416 are thereby opened allowing fluid communication between the tubing string inner bore and the annulus, which in this case allows fluid from the annulus to enter the tubing string and flow toward surface. In particular, fluid can bypass, arrows BP, around the seal created by ball 436 and seat 426*a*. A lock, such as a c-ring can be provided to prevent the inner sleeve from closing over ports 416.

In one embodiment, the driver can be configured to be driven through a plurality of passive cycles prior to driving the constriction into the active position.

A ball seat guard 464 can be provided to protect the collet 426. For example, as shown, ball seat guard 464 can be positioned on the uphole side of collet 426 and include a flange 466 that extends over at least a portion of the upper surface of the collet seat. The guard can be formed frustoconically, tapering downwardly toward the collet, to substantially follow the frustoconical curvature of collet seat 426*b*. Depending on the position of the guard, it may be formed as a part of the inner sleeve or another component, as desired. The guard may serve to protect the collet fingers from erosive forces and from accumulating debris therein. In one embodiment, the collet fingers may be urged up below the guard to force the fingers apart to some degree. After the collet moves to form the active seats 426*a*, 426*b* (FIG. 2B), it may be separated from guard 464. In this position, guard tends to funnel fluids and ball 454 toward the center of collet 426 such that the fingers of the collet continue to be protected to some degree.

As an example, a tubing string as shown in FIGS. 2A to 2E, when run in may drift at 2.62" (IDS=2.62") and IDL is greater than that, for example about 2.75". A 2.75" ball 436 can pass collet 426, but land in yieldable seat 446 to shift collet 426 over the tapered area to create a new seat on both the collet's uphole facing and downhole facing side of diameter IDS2, which may be for example 2.62".

After ball 436 lands and shifts the second sleeve to form a seat of diameter IDS2, seat 446 will yield to a diameter greater than the ball and the ball will continue downhole. The second sleeve may shift to form the new seat at a pressure, for example, of 10 MPa, while the seat yields at 17 MPa. In this process, the sleeve 432 does not move, the seals remain seated and unaffected and port openings 416 do not open. That ball 436 can thereafter land in a lower 2.62" seat 22*a* below the flow control assembly and open the sleeve actuated by that sleeve's seat. If desired, a frac can be conducted at that stage.

When pressure is dissipated, ball 436 flows back up and cannot pass seat 426*a*. This creates a seal against further back flow, offering well control in the string.

When it is desired to open openings 416, a second ball 454 is pumped down that is sized to land in and seal against collet 426. Such a ball may be, for example, 2.75", the same size as ball 436. Ball 454 will shift the sleeve 432 to open openings 416 such that communication is opened between annulus and the tubing inner diameter above the collet. Sleeve 432 may shift at a pressure greater than that used to yield seat 446, for example, 24 MPa.

Since ports 17*a* are already open and ports 416 are now open, fluid from the tubing string, annulus and formation downhole of collet, which was previously contained by ball 436 and seat 426*a*, can flow out of the tubing string, arrows BP.

Figure 3:
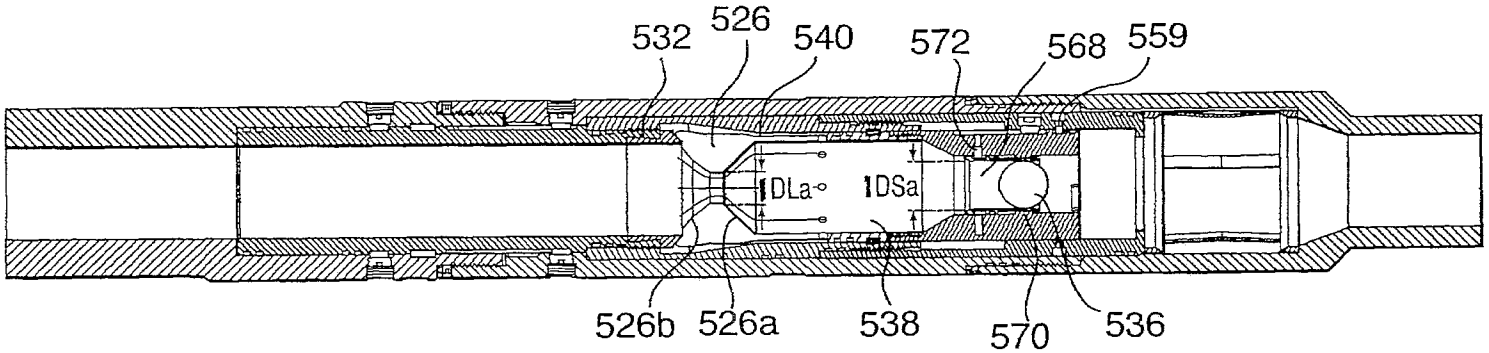
FIG. 3 is a sectional view through another sleeve according to an aspect of the invention.

The well control assembly of FIG. 2 can be modified in several ways. For example, in one embodiment, as shown in FIG. 3, the driver can be formed as a sub sleeve 568 with a yieldable seat 546 able to yield under pressure. The yielding effect is initially restricted by a rear support 570 behind the sub sleeve in the run in position. The well control seat in this embodiment is a collet 526 that is initially in an inactive condition with a larger diameter IDLa and further downstream the yieldable ball seat with sub sleeve 568 has a smaller diameter IDSa. This configuration allows a ball 536 to pass through the collet and land in the yieldable ball seat and isolate the upstream tubing pressure from the downstream tubing pressure. The upstream pressure is increased by surface pumping and the pressure differential across the yieldable seat develops a force that exceeds the resistive shear force of pins 559 holding the second sleeve 538 within the inner sleeve 532. As the second sleeve moves, collet 526 is moved with the sleeve a short distance along a tapering region 540 of the inner sleeve 532 resulting in the fingers of the collet being compressed and resulting in a decrease in diameter across the fingers forming the collet 526, thus forming well control seat 526*a*. With further application of pressure, the force developed will be sufficient to shear further pins 572 holding the sub sleeve to move the yieldable seat off the rear support 570 and the material of the sub sleeve can then expand and yield to allow the ball 536 to pass. The yieldable seat can be formed as a necked region in the material of the sub sleeve and be formed to be yieldable, as by plastic deformation at a particular pressure rating. In one embodiment, the yieldable seat is a thin sleeve material. In another embodiment, the yieldable seat is a plurality of collet fingers with inwardly turned tips forming the necked region.

As noted previously, the ball stops and sealing areas of the driver and shifting sleeve can be formed in various ways. In some embodiments, the ball stops and sealing areas are combined as shown in FIG. 2 and FIG. 3. However, it is noted that the ball stop can be provided separately, but positioned adjacent to a sealing area.

The above-noted well control may be particularly valuable where, after manipulations through one tubing string, other wellbore operations are being carried out that may be hindered by the back flow of fluids through that tubing string. For example, the well control apparatus, installation and method may be useful in a multi-leg well. In summary, with reference to FIG. 4, a multi-leg well is formed through a formation 706 and includes a main wellbore 708 and a plurality of wellbore legs 711*a* and 711*b* that extend from the main wellbore. While a dual lateral well with two wellbore legs is shown, a multi-leg well may include any number of legs.

Figure 4A:
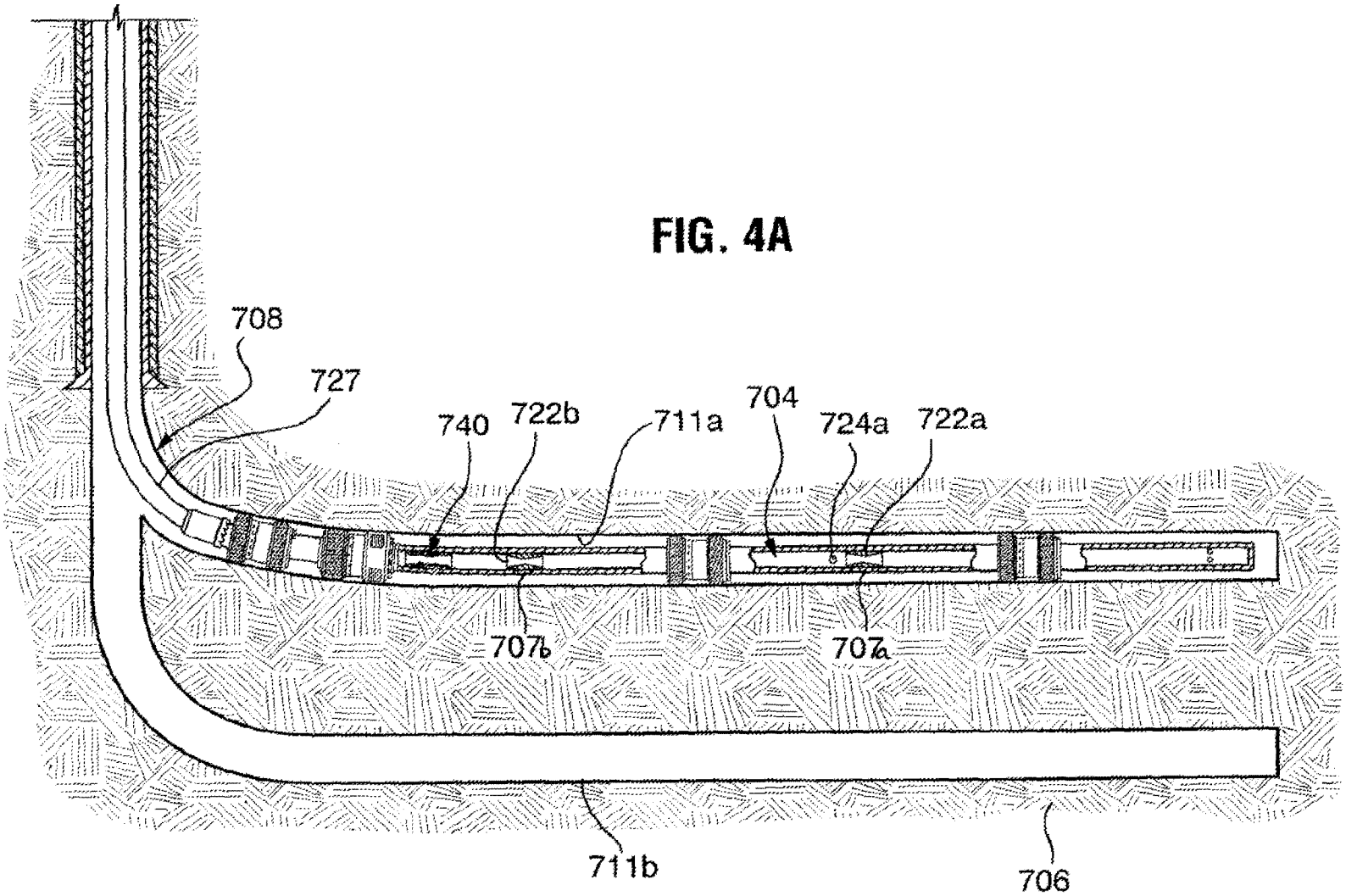
FIG. 4A to 4E are sequential schematic views of operations in a multi-leg well.

One or more of the legs can be treated as by lining, stimulation, fracing, etc. For example, the method may include running an apparatus 704 into at least one of the legs (FIG. 4A). Running in may include positioning the string, setting packers to seal the annulus between the apparatus and the wellbore wall and setting slips. Packers may create isolated segments along the wellbore. The apparatus may be for wellbore treatment or production and may include one or more plug-actuated tools 722*a*, 722*b* driven by one or more plugs 724, a well control apparatus 740 including a constriction 742 for creating a seal against back flow and a bypass configuration including a bypass port system openable into communication with each other, one on either side of the constriction to permit bypass about the constriction and the seal created by it when it becomes of interest to reopen the wellbore leg to back flow.

Figure 4B:
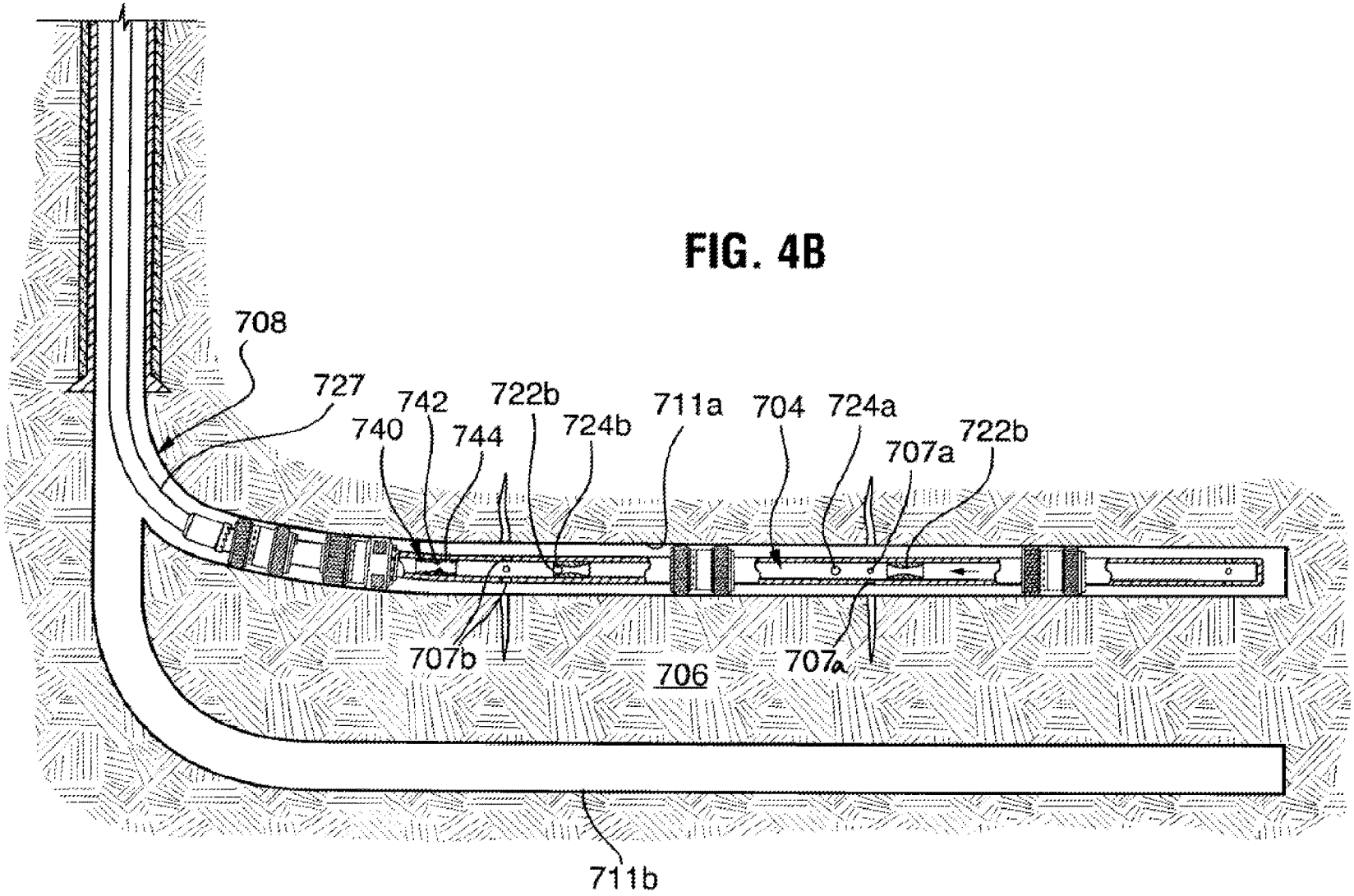

In the illustrated embodiment, for example, apparatus 704 includes a tubing string through which wellbore fluid treatment is effected and tools 722*a*, 722*b* are formed as sliding sleeves actuated by plugs 724*a*, 724*b*. Plugs 724*a*, 724*b* can be conveyed into the apparatus to land in seats 726 on the sleeves and create pressure differentials to move the sleeves from a closed position to an open condition, to expose ports 707*a*, 707*b*. Wellbore treatments, such as fluid injection, as for fracturing the well, may be carried out through the opened ports 707 (FIG. 4B). Wellbore treatments may be communicated from surface to the apparatus through a string 727 that connects onto the apparatus. String 727 includes a long bore therethrough that permits the conduction of fluid and plugs 724 from surface to the apparatus.

Figure 4C:
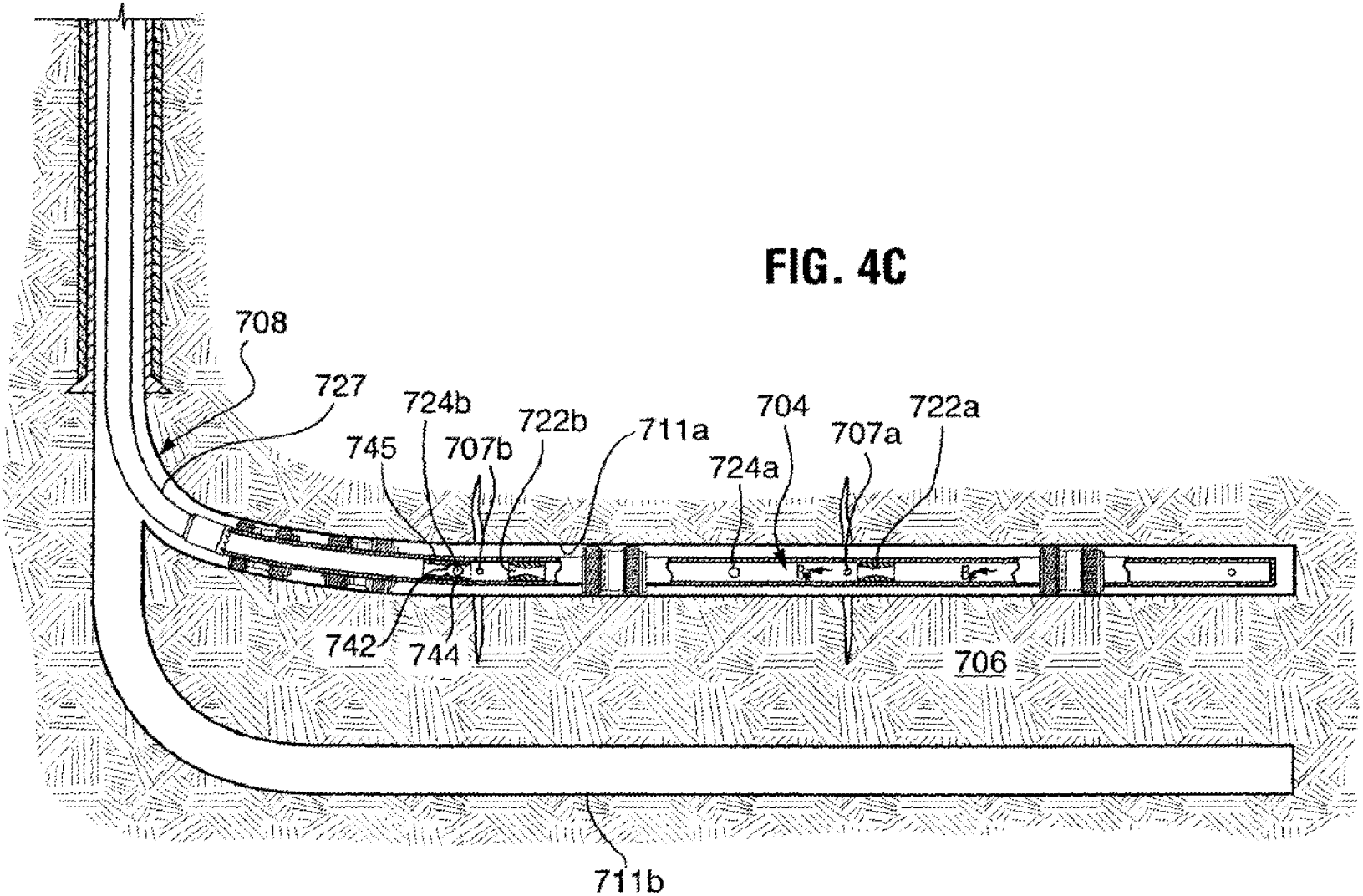
Figure 4D:
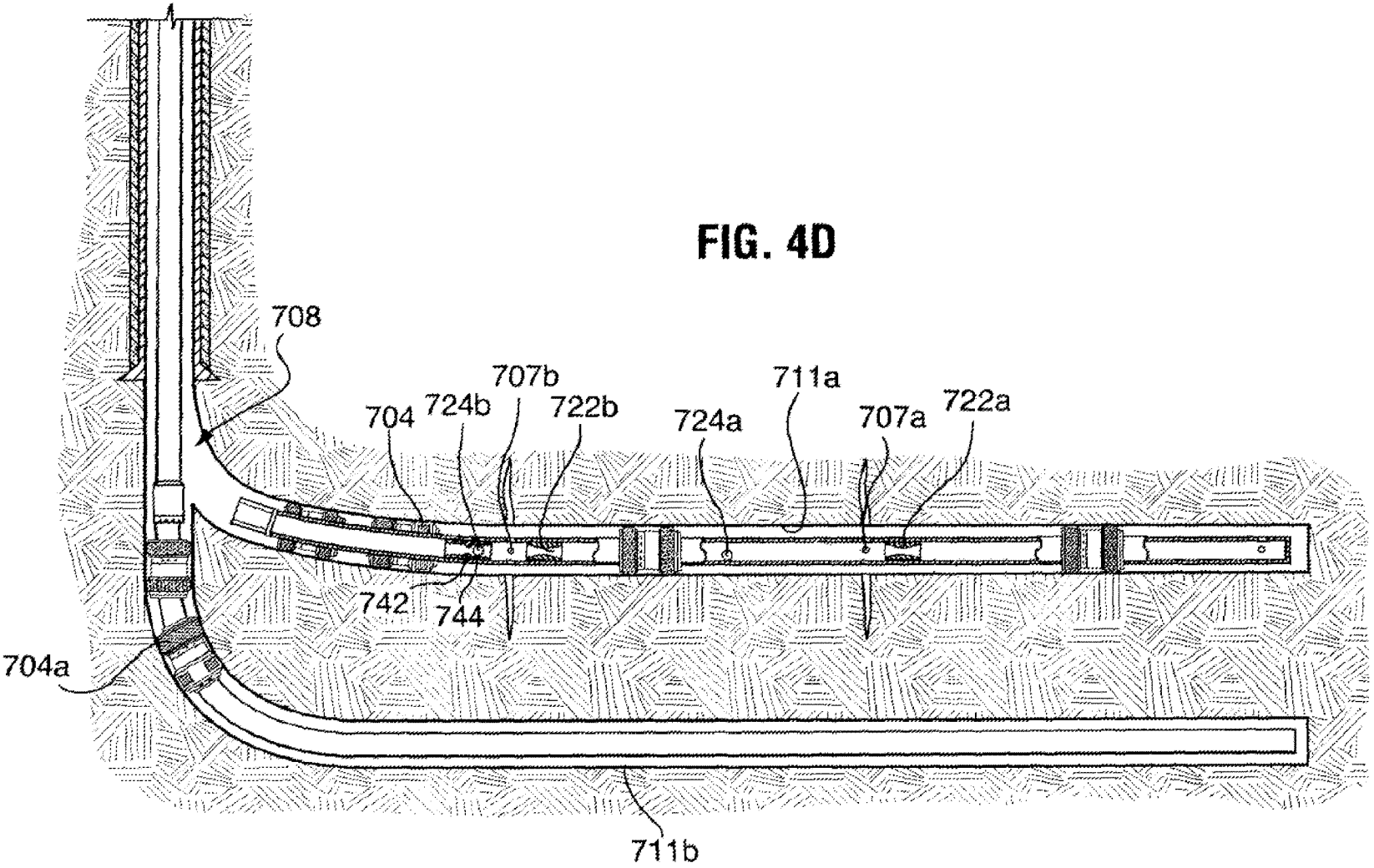
Figure 4E:
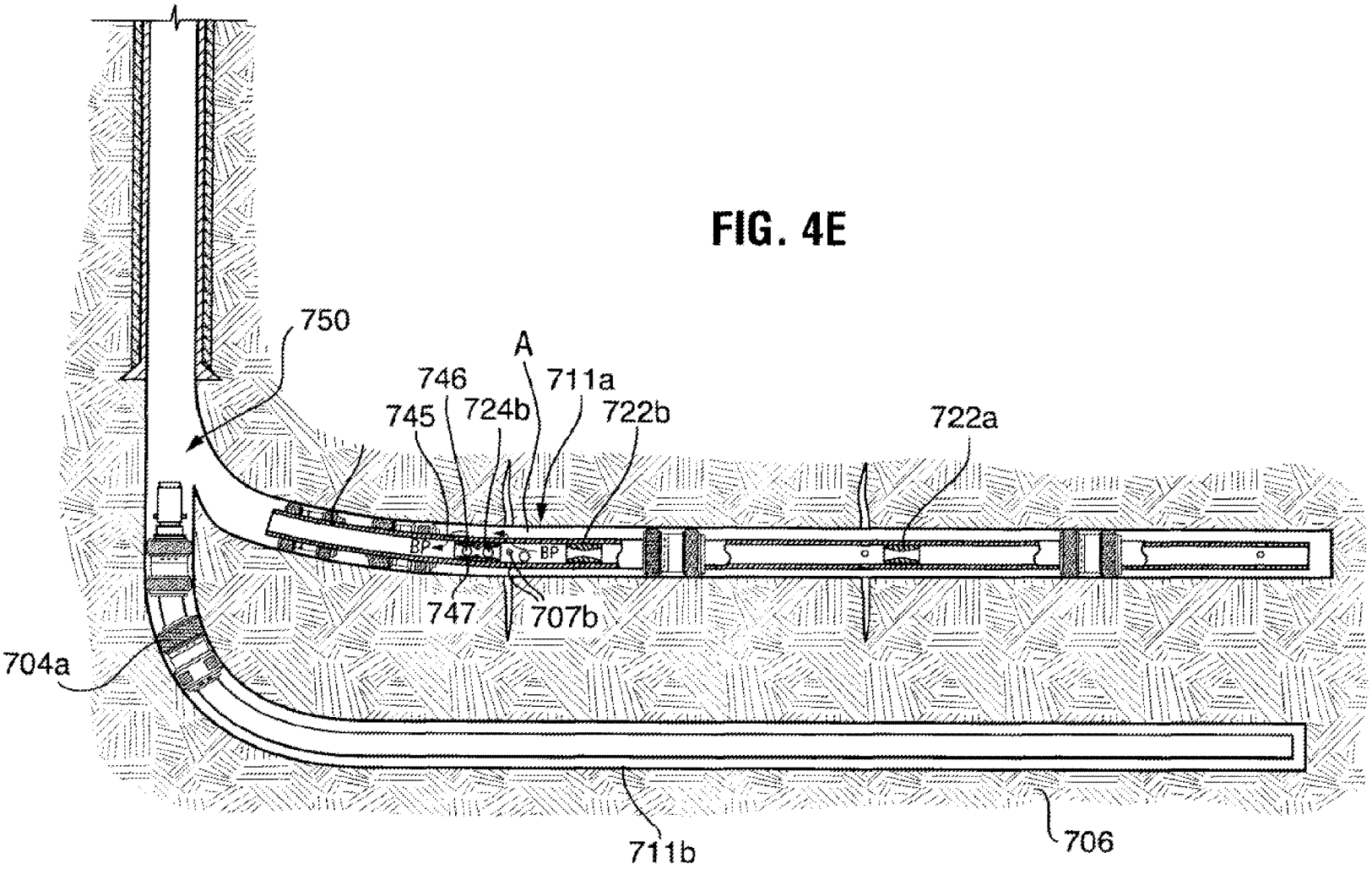

After the wellbore treatments, fluids in the well, that introduced during treatments and that produced from the formation, may begin to flow back in the well, as shown by arrows BF. If it is decided that uncontrolled back flow of fluids may interfere with other operations in the well, it may be useful to set a well control seal using the well control apparatus 740 to create a seal against back flow (FIGS. 4C and 4D).

As noted, apparatus 740 includes constriction 742 actuatable from an inactive position (FIG. 4A) to an active position (FIG. 4B) by a driver. Ball stopper 743 may be a plurality of dogs that can normally be pushed out of the way by plugs moving therepast but are driven out into an active position and supported against further radial movement by the driver. In this embodiment, constriction is carried in an inactive position, by is driven into the active position by the last plug 724*b* launched to actuate a sleeve. When activated, the constriction forms a ball stopper 743 in the tubing string inner diameter positioned just up hole of a sealing area 744. Ball stopper 743 and sealing area 744 are sized to stop and create a seal with plug 724*b*. In particular, when pumping pressures are dissipated such that back flow can begin, plug 724*b* is unseated from its sleeve 722*a* and is carried by back flow of fluids, arrows BF, uphole until it reaches the constriction where it seats in sealing area 744 to create a seal against further back flow, offering well control (FIG. 4C).

Other plugs 724*a* also become trapped in the apparatus 704 behind, downhole of, the constriction.

Operations may then be carried out in other parts of the well, including in main wellbore 708 or in other legs 711*b*. In one embodiment (FIG. 4D), wellbore operations may be carried out including installation of another apparatus 704*a* in another wellbore leg 711*b*. Plug-actuated operations may be conducted in the other apparatus 704*a*.

If desired, when it is appropriate to reestablish back flow, a fluid bypass can be established about the constriction. As noted, apparatus 740 further includes a bypass configuration including a bypass port system including a first port and a second port openable into communication with each other, one on either side of the constriction to permit bypass about the constriction and the seal created by it when it becomes of interest to reopen the wellbore leg to back flow. In the illustrated embodiment, the fluid bypass in part makes use of fracing ports through the tubing string. In particular, ports 707*b* of the upper most frac port are in communication with further ports 745, intended for opening during a bypass procedure. Ports 707*b* are downhole of the seal created at constriction 742 and ports 745 are uphole of the seal created at the constriction and both sets of ports are in communication along annulus A on the outside of the string of apparatus 704 (i.e. no packers are installed in the annulus between the two ported intervals). As such, when both ports 707*b* and 745 are open, back flowing fluid can bypass out through port 707*b*, along the annulus and in though port 745 (arrows BP, FIG. 4E).

When it is desired to open the bypass about constriction 742, ports 707*b* are already open and ports 745 can be opened, among other ways, for example, by launching a ball 746 to move a sleeve 747 covering them, which may or may not be connected to constriction 742.

Later, to fully open the apparatus, apparatus 740 can be removed, as by drilling out constriction 742, sealing area 744 and sleeve 747. For example a drilling string with a cutting head may be run into the apparatus and engaged against sleeve 747, constriction 742 and/or sealing area 744 to drill it out. Balls 724 can then flow out of the apparatus toward surface. Sleeves 722 can also be drilled out in this operation.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A sleeve for controlling back flow in a tubing string installed in a well, comprising:

a constriction member having an inactive position and an active position, the constriction member formed to allow a first plug to pass therethrough in a downhole direction when in the inactive position, and to form a downhole facing seat to stop the first plug and a fluid in the well from displacement in an uphole direction when in the active position;

a driver to move the constriction member between the inactive position and the active position; and a bypass port in the tubing string openable by a second plug when the constriction member is in the active position, to allow the fluid to bypass the seal formed by the seat and the first plug to flow in the uphole direction.

2. The sleeve as claimed in claim 1, wherein the constriction member is a collet slidably disposed in the sleeve, the collet comprising a plurality of fingers constrictable against a tapered section of the sleeve to form the seat.

3. The sleeve as claimed in claim 1, wherein the driver is to capture the first plug to generate the downhole facing seat in the constriction member.

4. The sleeve as claimed in claim 1, wherein the driver comprises a yieldable seat.

5. The sleeve as claimed in claim 1, wherein the constriction member comprises a plurality of collet fingers.

6. The sleeve as claimed in claim 1, further comprising a ball seat guard to direct the first plug and the second plug towards a center of the constriction member.

7. The sleeve as claimed in claim 1 further comprising a sleeve axially slideable in the tubing string to regulate opening of the bypass port as a result of actuation by the second plug.

8. The sleeve as claimed in claim 1, further comprising a sliding sleeve valve disposed downstream of the sleeve, wherein the sliding sleeve valve is actuable by the first plug to open a main port in the tubing string.

9. A method for controlling backflow in a well, the well including a tubing string having a constriction member and a driver, the method comprising:

conveying a first plug into the tubing string, wherein the plug is to:

pass through the constriction member, when flowing in a downhole direction; and form a seal, when flowing in the uphole direction, against a seat formed in the constriction member to stop backflow of fluid through the constriction member; and conveying a second plug into the tubing string to open a bypass port uphole from the seal formed by the constricting member and the first plug, for enabling the fluid to flow in the uphole direction around the seal.

10. The method as claimed in claim 9, wherein conveying the first plug comprises applying fluid pressure to the first plug captured at the driver to squeeze the first plug through the driver.

11. The method as claimed in claim 9, wherein conveying the second plug comprises applying fluid pressure to the second plug to slide a sleeve in the tubing string to open the bypass a port.

12. The method of claim 9, further comprising actuating a sliding sleeve provided downhole from the seal to open a fluid port.

13. The method as claimed in claim 12, wherein fluid is enabled to flow in the tubing string in the uphole direction through the fluid and the bypass port, bypassing the seal.

14. A flow control assembly for a tubing string provided with a bypass port, comprising:

a first sleeve slidable mounted inside the tubing string over the bypass port;

a second sleeve slidable moving in the first sleeve, including:

a constriction member actuable from an inactive position to an active position, to form both a downhole facing seat and an uphole facing seat in the active position; and a driver positioned downstream of the constriction member adapted to actuate the constriction member into the active position by a first plug traveling in the downhole direction, the downhole facing seat being adapted to discontinue travel of the first plug and the back flow of fluid in the uphole direction;

the uphole facing seat being adapted to actuate the first sleeve to open the bypass port when actuated by a second plug launched in the downhole direction.

15. The flow control assembly of claim 14, further comprising a pair of seals provided on both sides of the bypass port between the first sleeve and the tubing string to fluidly isolate the bypass port when the first sleeve is over the fluid port.

16. The flow control assembly of claim 14, further comprising one or more O-rings to attach the first sleeve to the tubing string over the bypass port.

17. The flow control assembly of claim 14, further comprising one or more shearable pins for holding the second sleeve within the first sleeve when the constriction member is in the inactive position.

18. The flow control assembly of claim 17, wherein the first sleeve comprises a stop wall to stop downhole movement of the second sleeve within the first sleeve once the constriction member is in the active position.

19. The flow control assembly of claim 14, wherein the driver comprises a yieldable ball seat for enabling the first plug to move past the yieldable ball seat under hydraulic pressure.

20. The flow control assembly of claim 19, wherein the inner diameter of the constriction member in the inactive position is larger than the inner diameter of the yieldable seat, to enable the first plug to pass through the constriction member.

* * * * *